United States Patent [19]

Phillips

[11] 3,952,916

[45] Apr. 27, 1976

[54] AUTOMATIC DISPENSER FOR PERIODICALLY ACTUATING AN AEROSOL CONTAINER

[75] Inventor: Stanley J. Phillips, Wallingford, Conn.

[73] Assignee: Warner-Lambert Company, Morris Plains, N.J.

[22] Filed: Jan. 6, 1975

[21] Appl. No.: 538,701

[52] U.S. Cl. ..... 222/70; 222/162

[51] Int. Cl.[2] ..... B67D 5/08; B67D 5/64

[58] Field of Search ..... 222/70, 162; 239/70

[56] References Cited

UNITED STATES PATENTS

| | | | |
|---|---|---|---|
| 2,673,008 | 3/1954 | Ryan | 222/162 |
| 2,904,223 | 9/1959 | Ryan | 222/162 |
| 3,228,609 | 1/1966 | Edelstein | 239/70 |

*Primary Examiner*—Allen N. Knowles
*Assistant Examiner*—Hadd Lane
*Attorney, Agent, or Firm*—Albert H. Graddis; Jeremiah J. Duggan

[57] ABSTRACT

The specific disclosure provides an automatic dispenser for periodically actuating a replaceable aerosol container to discharge a quantity of the contents of the container. The aerosol container includes a valve, means for biasing the valve to a closed position, an outwardly extending valve stem having an internal passage in fluid communication with the valve and a discharge outlet in fluid communication with the stem passage. The container discharges a quantity of the contents therein through the valve, the passage and the discharge outlet upon relative movement between the valve stem and the container against the biasing means. The dispenser includes a housing having an aperture, means connected interiorly of the housing for maintaining the discharge outlet and valve stem in fixed alignment with the housing aperture, and means within the housing for automatically and periodically moving the aerosol container with respect to the valve stem against the biasing means to discharge a quantity of the contents of the container from the discharge outlet through the housing aperture.

3 Claims, 4 Drawing Figures

AUTOMATIC DISPENSER FOR PERIODICALLY ACTUATING AN AEROSOL CONTAINER

BACKGROUND OF THE INVENTION

1. Field of the Invention

The present invention relates to a system for automatically and periodically discharging a quantity of spray from an aerosol container. More specifically, the present invention relates to an automatic aerosol dispensing system in which the nozzle of the aerosol container is maintained in a fixed position during operations.

2. Description of the Prior Art

Pressurized aerosol containers have achieved wide usage in dispensing materials such as deodorizers, insecticides, germicides and the like. Such containers are commonly provided with an upwardly projecting valve having a spray nozzle. The valve may be opened with downward pressure, or in some cases, or in some cases, by tilting the valve to one side. There are two basic types of values. One type provides a continuous spray as long as the valve is depressed, and the other type provides a single metered spray upon depression of the valve.

There are numerous applications in which it is advantageous to automatically and periodically actuate the valve of an aerosol container to dispense a predetermined quantity of spray at periodic timed intervals. There are also numerous automatic dispensers presently on the market. Devices of this kind are commonly provided with an electric motor with means for periodically actuating the valve. Other devices of this kind operated with motors which are energized by high voltage alternating current at the usual line potential. Consequently, it is necessary to provide a line cord for connecting such device to the alternating current source. When it is desired to place the device in a location where there is either no nearby outlet or whereby the provision of a line cord would be objectionable, battery electrical power sources are to be employed.

Devices for driving a DC motor from batteries to accomplish a periodic actuation from an aerosol container are also well known. For example, U.S. Pat. No. 3,543,122 discloses an automatic aerosol dispenser wherein a DC motor drives a gear which, in turn, is coupled by means of an eccentric drive to a valve actuator in the form of a ring. The eccentric drive includes a ball which is driven between the ring and a drum to drive the ring against the valve to emit a burst of spray. The ring is spring loaded so that upon reversal of the DC motor, as controlled by a separate reversing element, valve actuation is terminated.

Another DC motor driven automatic aerosol dispensing device is disclosed in the U.S. Pat. No. 3,289,886. In this patent a DC motor is shown connected through reduction gearing to a cam. The cam, in turn, is engaged by a cam follower which is coupled to a spring loaded valve-engaging element. The valve-engaging element is urged downwardly against the valve. When an undulation on the cam is rotated to an appropriate position by the DC motor, the valve-engaging element is released to depress the valve and a burst of spray is emitted. In additon, the output of the reduction gear train rotates a mechanical delay-switch which periodically energizes the motor for short time periods to rotate the cam 180° for a valve actuation.

The automatic aerosol dispensing devices shown in U.S. Pat. Nos. 3,543,122 and 3,289,886 include mechanical elements which increase the complexity of the device. For example, the mechanical delays employed in both of these devices require additional structural features which are rotated by the motor. Additional mechanical elements such as the cam in U.S. Pat. No. 3,289,886 or the eccentric ball mount in U.S. Pat. No. 3,543,122 are necessary to actuate the output valve of an aerosol container. A spring loading feature employed in the dispenser of U.S. Pat. No. 3,289,886 presents an additional undesired force which must be overcome during rotation of the motor and thus, demands additional energy from the power supply.

In another type of periodically operated aerosol container, a motor may be employed which is continuously rotated on AC power, e.g., U.S. Pat. Nos. 3,018,056, 2,928,573 and 2,613,108.

In U.S. Pat. No. 2,928,573, valve is depressed by a flat metal plate connected to the output shaft of a reduction gear train driven by a synchronous AC motor. The motor is continuously operated, but when the metal plate contacts and depresses the metering valve, an automatic motor reversal occurs. As the flat metal plate is then rotated away from the valve, contact is made with a stop where another motor reversal arises to again advance the flat metal plate to the valve for its actuation. The automatic spray dispenser described in U.S. Pat. No. 3,018,056 utilizes a continuously driven cam to pivot a pair of valve-engaging links in sequence for a metered burst of spray.

Periodically operated solenoids are employed in automatic aerosol dispensers as described in the U.S. Pat. Nos. 3,351,240 and 3,187,949.

In U.S. Pat. No. 3,351,240, an electronic timing circuit generates an output pulse which turns an electronic transistor switch on for a time period sufficient to energize a solenoid whose armature is moved to permit the emission of a burst of spray. In U.S. Pat. Nos. 3,187,949 and 3,351,240, the armatures of the solenoids form an integral part of a modified valve. Such construction is complex and tends to demand excessive electrical power from limited power sources such as batteries.

U.S. Pat. No. 3,739,944 provides an automatic spray dispenser in which a DC motor is positively coupled by a reduction gear train and a valve contacting element to the nozzle portion of an aerosol container. The valve contacting element which normally rests upon the nozzle portion, depresses the nozzle portion upon motor actuation to thereby move the nozzle downwardly and open a spring loaded output valve. A timing circuit delivers pulses of electrical power from a battery power source to the motor. Motor rotation persists until the valve seats at the end of its stroke, and the DC motor is stalled towards the end of the power pulse. When power to the DC motor is terminated at the end of a power pulse, the spring loaded valve is allowed to return the valve contacting element to its normal position.

Sprays are discharged from aerosol containers in an outwardly opening conical shape. U.S. Pat. No. 3,739,944 and the other above noted patents provide for the actuating mechanism to apply force to the top of the nozzle to move a valve stem inwardly to open the aerosol valve. For example, a valve stem may initially move inwardly 0.04 to 0.045 inch before initiating the spray, and continue inward movement an additional 0.04 inch during the spray. However, such movement also moves the discharge outlet of the aerosol container with respect to an aperture in the dispenser housing. Movement between the aerosol outlet and the housing aperture presents a risk of a portion of the conical spray striking the housing about the aperture as the spray moves downwardly to thereby reduce the efficiency of the spray and cause a portion of the contents to accummulate on the housing.

SUMMARY OF THE INVENTION

It is an object of the present invention to maintain the discharge outlet of the aerosol container in fixed alignment with the housing aperture during actuation of the valve to an open position.

In accordance with the present invention there is provided an automatic dispenser for periodically actuating a replaceable aerosol container to discharge a quantity of the contents of the container. The container includes a valve, means for biasing the valve to a closed position, an outwardly extending valve stem having an internal passage in fluid communication with the valve and a discharge outlet in fluid communication with the stem passage. The container discharges a quantity of the contents therein through the valve, the passge and the discharge outlet upon actuation of the valve to an open position by relative movement between the valve stem and the container against the biasing means. The dispenser includes a housing having an aperture, means connected interiorly of the housing for maintaining the discharge outlet and valve stem in fixed alignment with the housing aperture during actuation of the valve and means within the housing for automatically and periodically moving the aerosol container with respect to the valve stem against the biasing means to actuate the valve to an open position and thereby discharge a quantity of the contents of the container from the discharge outlet through the housing aperture.

DESCRIPTION OF SPECIFIC EMBODIMENTS

Figure 1:
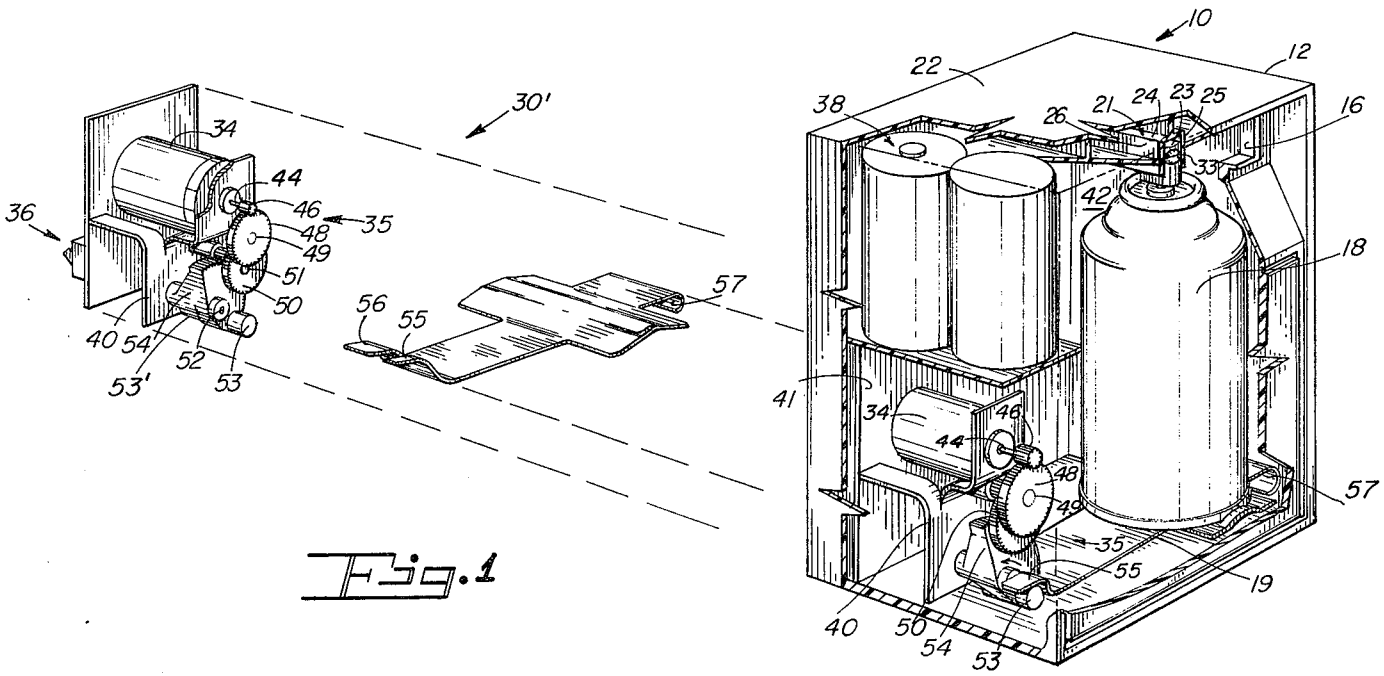
FIG. 1 is a perspective view of an automatic aerosol dispenser in accordance with the present invention with a portion of the housing broken away.
Figure 4:
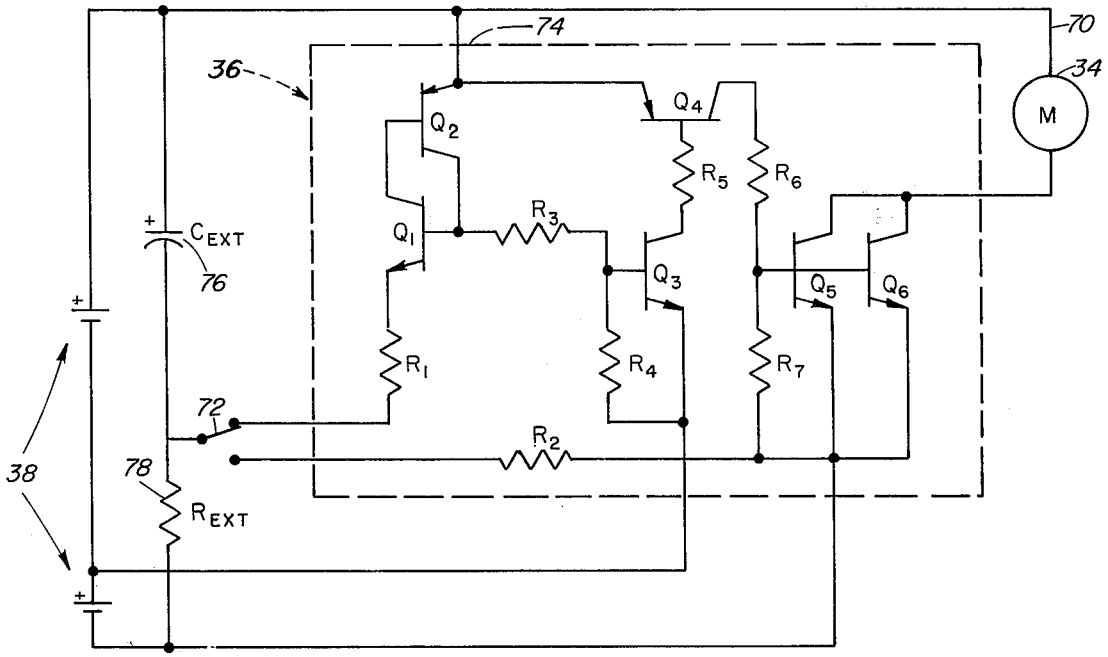
FIG. 4 is a schematic of a timing circuit embodiment suitable for use with the dispenser of FIG. 1.

With refernce to FIGS. 1 and 4, an automatic spray dispenser 10 in accordance with the invention has a housing 12, and the housing 12 has an aperture 16 through which a burt of spray from an aerosol container 18 can be discharged into a surrounding environment. The aerosol container 18 is supported on a lever 19. The container 18 has an actuator button 20 positioned in a bifurcated bracket 21 extending downwardly from a top wall 22 of the housing 12. In an unactuated state, the top surface 23 of the button 20 is spaced a slight distance from the bottom surface of the top wall 24 of the bracket 21 to permit a user to insert the container 18 between the bracket 21 and the lever 19 without depressing the button 20. Side walls 25, 26 of the bracket 21 parallel the sidewalls of the button 20 to limit lateral movement of the button 20.

Figure 2:
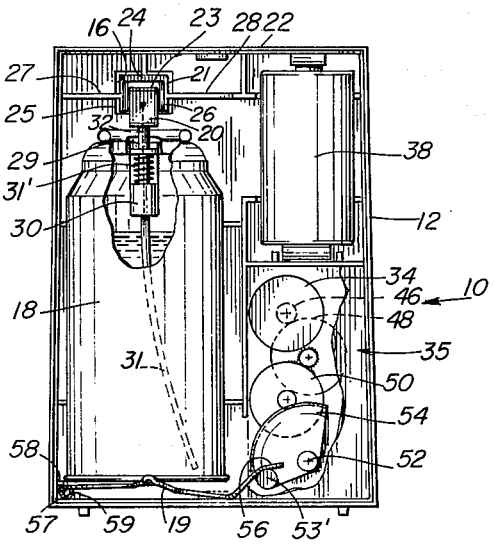
FIG. 2 is a rear elevational view in an unactuated state of the internal structure of the dispenser shown in FIG. 1.

As shown in FIG. 2, the side walls 25, 26 can have lateral support members 27, 28 integrally molded with the housing 12 and the bracket 21.

With reference to FIG. 2, the button 20 is connected to a valve stem 29 which in turn is connected to a valve 30. The valve 30 is biased to a closed position by a spring acting against a radially extending portion of the stem 29. A preferred valve is of the metering type which are well known in the aerosol container art. A suitable metering valve is described in U.S. Pat. No. 3,464,596 which patent is incorporated herein by reference. When the valve 30 is actuated to an open position contents which were fed to a metering chamber (not shown) in the valve 30' by a dip tube 31 pass through a passage 32 in the valve stem 29 and through a discharge outlet 33 (FIG. 1) in the button 20.

An automatic system 30 is used to actuate the valve 30 to an open position and includes a DC motor 34, a reduction gear train 35, an electric timing circuit 36 and a supply 38 of DC power in the form of a pair of series connected flashlight batteries. One end of the DC motor 34 and gear train 35 are mounted on a bracket 40, and the other end of the motor 34 and the circuit 36 is mounted on another bracket 41 spaced from a removable rear wall 42 of the housing 12.

The DC motor 34 has an output shaft 44 provided with a pinion 46 which engages a first cluster gear 48 in the reduction gear train 35. The gear train 35 is shown formed of a number of reductions with first and second cluster gears 48 and 50, each of which is further provided with pinions 49, 51 respectively to provide the desired torque conversion in a well-known manner.

The output pinion 51 engages a gear 54 rotatable about axis 52 and which gear 54 has a pair of oppositely extending bosses 53, 53' for abutting engagement with the undersurfaces of a pair of spaced arms 55, 56 formed on one end of the lever 19. The other end of the lever 19 is downwardly curved 57 and is maintained in a pivotal position by a pair of brackets 58, 59 formed on the housing 12. When the gear 54 is rotated in the direction shown by the arrow in FIG. 1, the lever 19 is pivoted upwardly about its curved end 57 to lift the container and thereby actuate the valve 30.

FIG. 4 illustrates the electrical details of the timing circuit 36 which produces a pulse on line 70 to drive the motor 34. When a switch 72 is in the position not shown, an integrated circuit 74 is in an off-state, and an external capacitor 76 is charged through an external resistor 78 by the batteries 38. When the switch 72 is moved to the position shown, —3V is applied to the emitter of transistor Q1 to switch on Q1 which in turn switches on transistors Q2, Q3, Q4, Q5 and Q6. When Q5 and Q6 transistors are switched on, a pulse is applied to line 70 to actuate the motor 34 and cause a spray. The duration of the pulse is determined by the time needed for the capacitor 76 to discharge through a resistor R1 and the transistors Q1 and Q2. When a capacitor 76 is discharged to about +1.0V, transistor Q1 shuts off which in turn causes transistors Q2, Q3, Q4, Q5 and Q6 to shut off and remove power from line 70.

Thereafter, capacitor 76 is again charged by the batteries 38 through the resistor 78 until the turn on voltage of Q1 is reached, for example approximately 2.0V. A suitable charging time is approximately 15 minutes.

R4 and R7 are bias resistors, and R3, R5, and R6 are current limiting resistors. Pulses are periodically applied to line 70 as long as the switch 72 is in the position shown.

Figure 3:
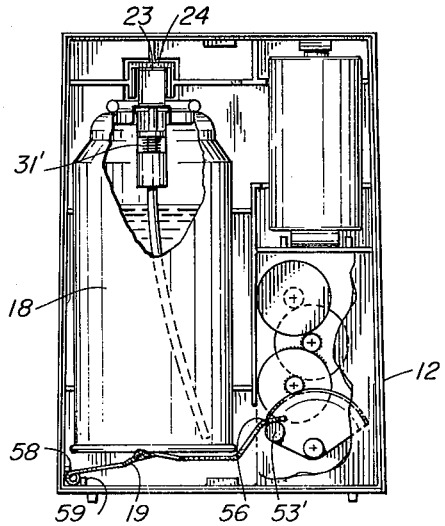
FIG. 3 is a rear elevational view of the internal structure in an actuated state.

When a pulse is applied to line 70, the gear 54 pivots the lever 19 about its curved end 57 to initially fully seat the top surface 23 of the button 20 against the top wall 24 of the bracket 21 and thereby bring the discharge outlet 33 and valve stem 29 into predetermined alignment with the housing aperture 16. The lever 19 continues to apply pressure to the underside of the container 18 to cause the container 18 to move upwardly with respect to the valve stem against the spring bias 31' to the position shown in FIG. 3 and thereby open the valve 30.

When power is removed from the line 70, the weight of the container 18 and the bias of the spring 31' act to pivot the lever 19 back to the position shown in FIG. 2 because the motor shaft 44 is free to rotate in a reverse direction.

The circuit components are preferably chosen to provide power pulses to the motor of sufficient duration to stall the motor after the button 20 is fully seated in the bracket 21 with the top surface 23 of the button 20 in abutting engagement with the top wall 24 of the bracket 21.

What is claimed is:

1. An automatic dispenser for periodically actuating a replaceable aerosol container to discharge a quantity of the contents of said container; said container including a valve, means for biasing said valve to a closed position, an outwardly extending valve stem having an internal passage in fluid communication with said valve, and a discharge outlet in fluid communication with said passage, said container discharging a quantity of the contents therein through said valve, said passage and said discharge outlet upon relative movement between said valve stem and said container against said biasing means to actuate said valve to an open position; said dispenser comprising:

a. a housing for said container, said housing including an aperture, b. means connected to the interior of said housing for maintaining said discharge outlet and said valve stem in fixed alignment with said aperture during actuation of said valve to the open position, and c. means within said housing for automatically and periodically moving said container with respect to said valve stem against said biasing means to actuate said valve to the open positon, said moving means comprising a pivotally mounted lever in abutting engagement with the underside of said container, a DC motor, a reduction gear train positively connecting the DC motor to the lever to deliver sufficient torque to pivot the lever and lift said container upon DC motor energization, said reduction gear train and positively connected DC motor further enabling the bias of the weight of said container to return the lever to its normally disposed position when the DC motor is de-energized, a supply of DC power, and a timing circuit coupling the DC power supply to the DC motor, said timing circuit producing output power pulses to periodically energize the DC motor for sufficient duration to pivot the lever and lift said container to actuate said valve to the open position, the power pulses from said timing circuit being of sufficient duration to stall the DC motor after opening said valve, said lever being pivoted in a reverse direction to its normal position at the end of each power pulse to prepare for a succeeding power pulse from the timing circuit, d. whereby a quantity of the contents of said container is discharged from said discharge outlet through said aperture.

2. The dispenser of claim 1 wherein said maintaining means comprises a bifurcated downwardly extending bracket, and wherein said container further includes an actuator button having said discharge oulet therein, said button being seated in said bracket.

3. The dispenser of claim 2 wherein said button is initially seated with an upper surface thereof spaced from an inner surface of said bracket, and wherein said moving means moves said upper surface of said button into abutting engagement with said inner surface of said bracket to align said discharge outlet and said valve stem with said aperture prior to actuation of said valve to the open position.

* * * * *